US009337531B2

(12) United States Patent
Wu

(10) Patent No.: US 9,337,531 B2
(45) Date of Patent: May 10, 2016

(54) METHOD AND SYSTEM FOR ANTENNA SHARING

(71) Applicant: 6Harmonics Inc., Ottawa (CA)

(72) Inventor: Shiquan Wu, Ottawa (CA)

(73) Assignee: 6Harmonics Inc., Ottawa (CA)

( * ) Notice: Subject to any disclaimer, the term of this patent is extended or adjusted under 35 U.S.C. 154(b) by 0 days.

(21) Appl. No.: 13/903,426

(22) Filed: May 28, 2013

(65) Prior Publication Data

US 2014/0354887 A1 Dec. 4, 2014

(51) Int. Cl.
*H01Q 1/24* (2006.01)
*H01Q 1/52* (2006.01)

(52) U.S. Cl.
CPC ..... *H01Q 1/246* (2013.01); *H01Q 1/525* (2013.01)

(58) Field of Classification Search
CPC ..... H04N 21/00
USPC ..... 348/706
See application file for complete search history.

(56) References Cited

U.S. PATENT DOCUMENTS

| | | | | |
|---|---|---|---|---|
| 5,553,069 | A * | 9/1996 | Ueno et al. | 370/315 |
| 2006/0165022 | A1* | 7/2006 | Nast et al. | 370/310 |
| 2007/0117524 | A1* | 5/2007 | Do | 455/83 |
| 2011/0230146 | A1* | 9/2011 | Morishita et al. | 455/77 |
| 2013/0165134 | A1* | 6/2013 | Touag et al. | 455/452.1 |

OTHER PUBLICATIONS

"Managing TDD-FDD Interference between Co-Sited Base Stattions deployed in Adjacent Frequency Blocks," Wimax Forum, Nov. 3, 2009.*

* cited by examiner

*Primary Examiner* — Michael Teitelbaum
(74) *Attorney, Agent, or Firm* — Gowling WLG (Canada) LLP; Mark Sprigings

(57) ABSTRACT

The present disclosure provides a method and a system for antenna sharing for asynchronous TDD radios comprising an integrated antenna with plurality of antennas and a circuit to limit the co-located transmitters signals, a plurality of transmitters, each transmitter operable on a predetermined set of channels and coupled via a respective transmit switch to a combiner and in turn to an antenna, a plurality of receivers, each receivers operable on a predetermined set of channels and coupled via a respective receive switch to a splitter and in turn to an antenna and a switch controller connected to respective transmit and receive switches for asynchronously connecting at least one transmitter and at least one receiver to the antenna for effecting antenna sharing.

19 Claims, 7 Drawing Sheets

| | | | | | | | | | | | | | |
|---|---|---|---|---|---|---|---|---|---|---|---|---|---|
| Group-f1 | 14 | 15 | 16 | 17 | 18 | 19 | 20 | 21 | 22 | 23 | 24 | 25 | |
| Group-f2 | 26 | 27 | 28 | 29 | 30 | 31 | 32 | 33 | 34 | 35 | 36 | 38 | |
| Group-f3 | 39 | 40 | 41 | 42 | 43 | 44 | 45 | 46 | 47 | 48 | 49 | 50 | |

Antenna

METHOD AND SYSTEM FOR ANTENNA SHARING

FIELD OF THE INVENTION

The present invention relates to methods and systems for antenna sharing and is particularly concerned with asynchronous time-division duplex (TDD) radios.

BACKGROUND OF THE INVENTION

Referring to FIG. 1, there is illustrated a known antenna sharing frequency-division duplex (FDD) radio system. The FDD radio system 10 includes a shared antenna 12 with duplexer 14 having transmit and receive filters, 16 and 18, respectively. The transmit frequency and receiving frequency needs to be well separated so that the duplexer can have a good isolation between transmit and receive chains. The system also includes an intermediate frequency transceiver 20 having a transmit side 22, a receive side 24 and a master oscillator 26. The system also includes a base band component 30 with analog to digital converter 32 and digital down converter 34 on the receive path and digital up converter 36 and digital to analog converter 38 on the transmit path. The base band component 30 includes baseband processor 40. The FDD radio system 10 of FIG. 1 typically splits the available bandwidth between the transmit side and the receive side. For the example of FIG. 1 the transmit side uses 1930 to 1990 MHz, while the receive side uses 1850 to 1910 MHz.

As illustrated in FIG. 1, frequency-division duplex (FDD) radios can be co-located. Consequently, they have found it desirable to share an antenna.

Referring to FIG. 2, there is another known antenna sharing system for synchronous time-division-duplex (TDD) where transmit and receive use the same frequency but in different time intervals. All the radios are synchronized in transmit or in receive via a network or a global-positioning-system (GPS). As illustrated in FIG. 2, a 10 ms time frame is divided into 4 parts. The first part 60 is for all the base station radios to transmit and all the terminals to receive; the second part 80 is a transition gap to allow transceivers to switch from transmission mode to reception mode; the third part 10 is the time interval that all the terminals can transmit while all the base stations should be in receiving mode; the fourth part 120 is the receive to transmit transition gap. So all the radios are synchronized either in transmission mode or in receiving mode.

However, when co-located TDD radios are in asynchronous mode, one radio is in transmit mode with signal strength 23 dBm, while the other is in receiving mode with a desired weaker signal (~−90 dBm), there requires roughly 110 dB of isolation in between transmitting radio and receiving radio so that the receiver can work properly.

Referring to FIG. 3, there is graphically illustrated USA TV channel allocation prior to conversion from analog to digital TV transmission. As can be seen Channels 2 to 69 were allocated between 54 MHZ and 806 MHz with gaps 200, 202, 204 and 206 between 72 MHZ and 76 MHz, 88 MHz and 174 MHz, 216 MHz and 470 MHz and 608 MHz and 614 MHz, respectively.

Referring to FIG. 4, there is graphically illustrated USA TV channel allocation after conversion from analog to digital TV transmission. As can be seen Channels 2 to 51 were allocated between 54 MHZ and 698 MHz with the same gaps 200, 202, 204 and 206 between 72 MHZ and 76 MHz, 88 MHz and 174 MHz, 216 MHz and 470 MHz and 608 MHz and 614 MHz, respectively.

Systems and methods disclosed herein provide a system for antenna sharing to obviate or mitigate at least some of the aforementioned disadvantages.

SUMMARY OF THE INVENTION

An object of the present invention is to provide an improved methods and systems for antenna sharing with asynchronous time-division duplex (TDD) radios.

Accordingly, the present disclosure provides methods and systems for antenna sharing with asynchronous time-division duplex (TDD) radios for utilization of television broadcast channels with reduced transmit interferences to receivers.

BRIEF DESCRIPTION OF THE DRAWINGS

The present invention will be further understood from the following detailed description with reference to the drawings in which.

DETAILED DESCRIPTION OF THE PREFERRED EMBODIMENT

Figure 1:
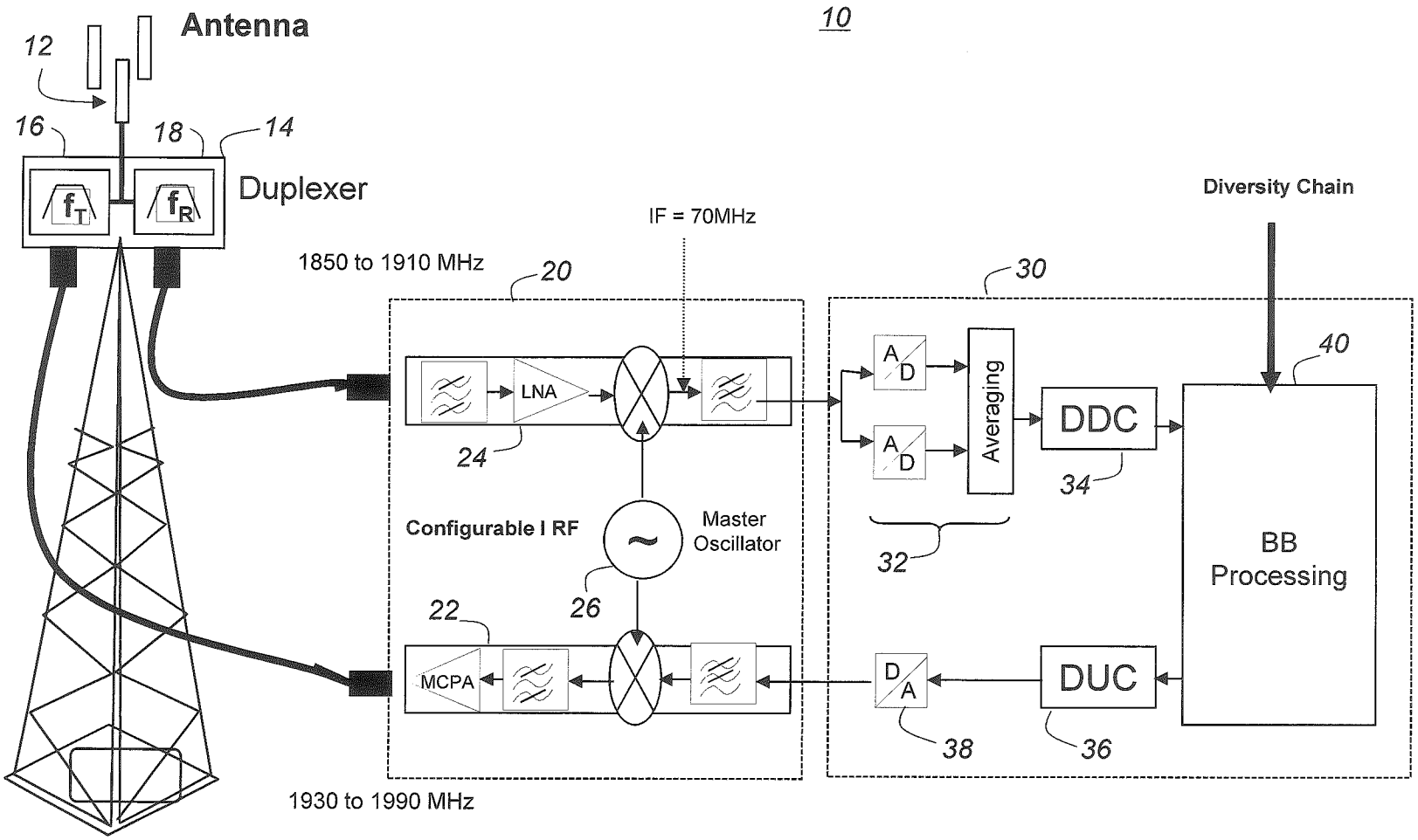
FIG. 1 illustrates in a block diagram a known frequency-division duplex (FDD) radios antenna sharing system.
Figure 2:
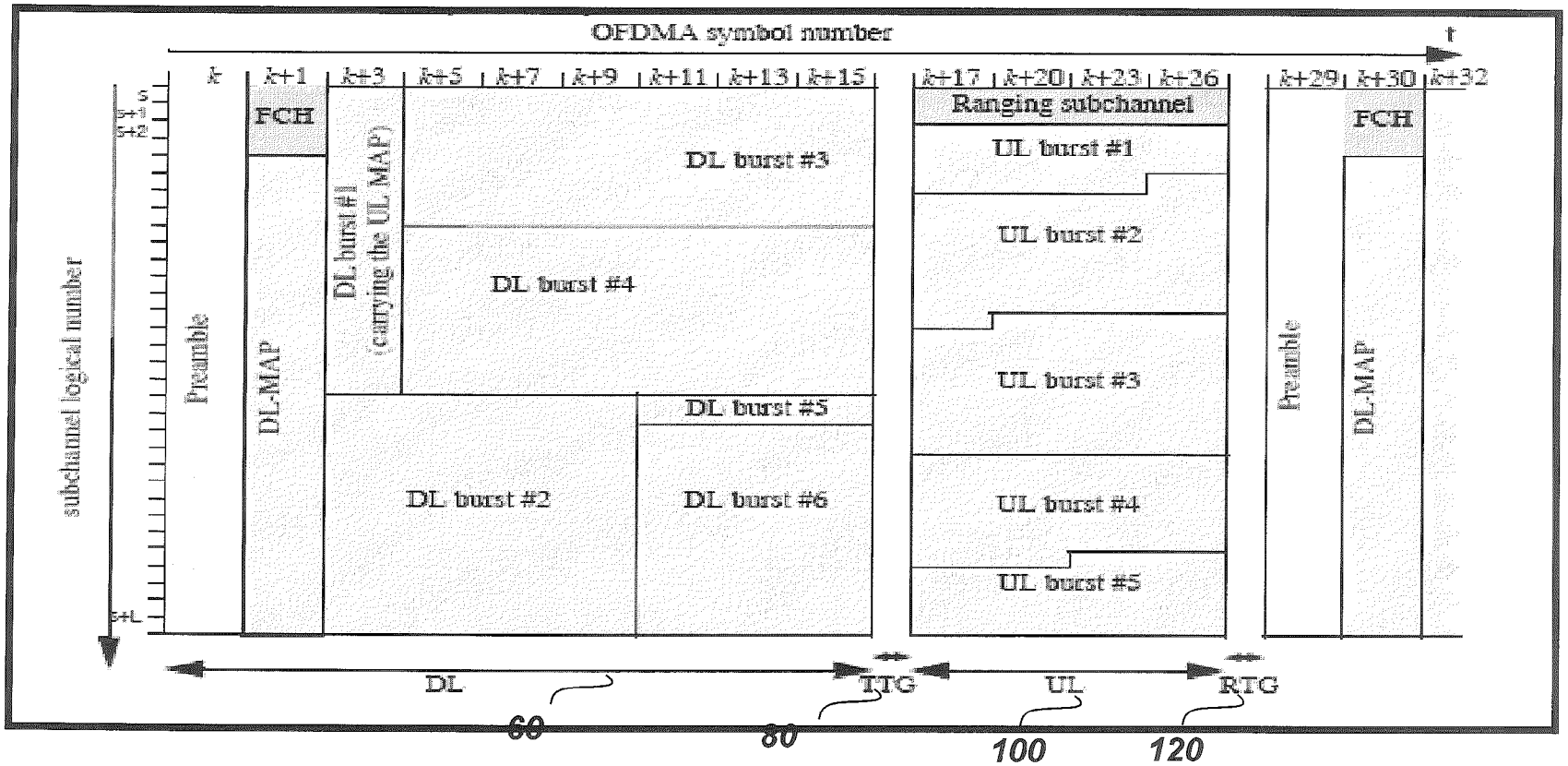
FIG. 2 illustrates another known synchronized time-division duplex (TDD) radios antenna sharing system. The base stations radios are scheduled to transmit in one time interval while terminals are all in receiving mode; terminals radios are scheduled to transmit in another time interval while base station radios are all in receiving mode.
Figure 3:
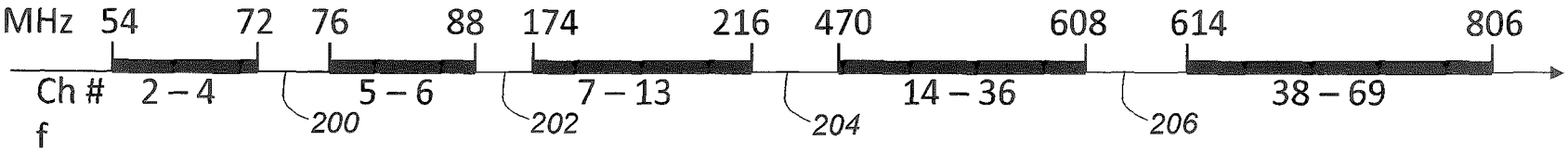
FIG. 3 graphically illustrates USA TV channel allocation prior to conversion from analog to digital TV transmission.
Figure 4:
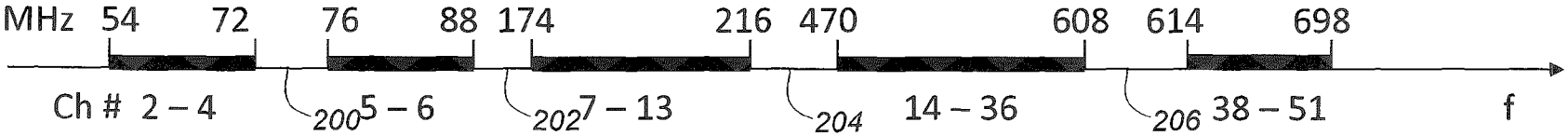
FIG. 4 graphically illustrates USA TV channel allocation after conversion from analog to digital TV transmission.
Figure 5:
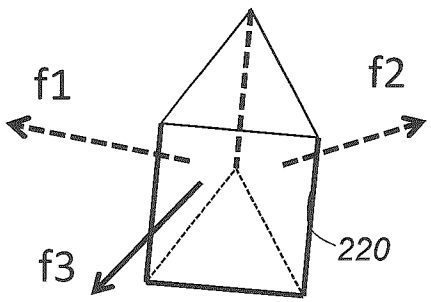
FIG. 5 illustrates a channel allocation method in accordance with a first embodiment of the present disclosure.

Referring to FIG. 5 there is illustrated a channel allocation method in accordance with a first embodiment of the present disclosure. According to this method three resonant frequencies f1, f2 and f3 are pre-selected for antenna 220 with each having TV channel frequencies assigned as shown in FIG. 5. Each resonant frequency will result one physical antenna piece, for example a half wavelength dipole, so there are 3 physical antennas and each will resonant at one frequency. 3 antennas will mechanically combined together to form one physical antenna.

Figure 6:
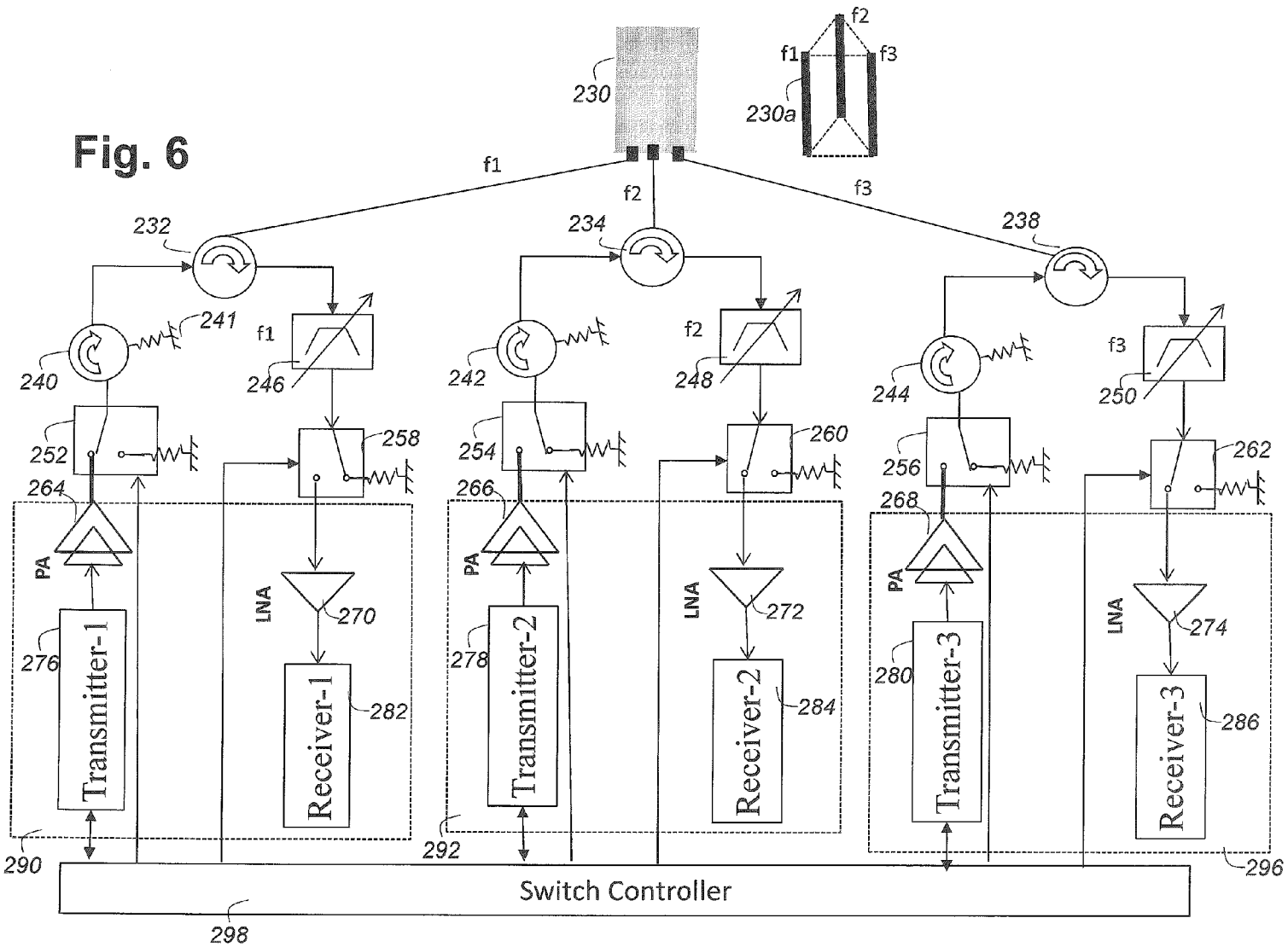
FIG. 6 illustrates an asynchronous TDD radio antenna sharing system in accordance with a second embodiment of the present disclosure.

Referring to FIG. 6 there is illustrated an antenna sharing system for asynchronous TDD radio systems in accordance with a second embodiment of the present disclosure. There are illustrated three asynchronous TDD radios 290, 292 and 296 sharing one physically looking antenna 230 and a control switch module 298. Each TDD radio system, 290 as an example, includes a transmit side 276 and a receive side 282.

In transmission mode, the transmitted signal is amplified by a power amplifier 264 meanwhile the switch controller 298 swings the switch 252 to connect the transmit circuit and switch 258 to disconnect. The signal then goes through an isolator 240 for which one pole is grounded to avoid the signal returns. The signal further goes through a circulator 232 which directs the signal towards the antenna and then radiates into air.

In receiving mode, the switch control 298 swings the switch 252 to disconnect while swing the switch 258 to connect. The antenna receives both desired signal and undesired signals including signals from collocated transmitters. Due to the fact that the antenna is optimized at frequency group f1, other undesired frequencies are first gated by antenna. The received signals go through the circulator 232, which passes the signal at frequency f1 and further reduces the undesired signals at other frequencies. The received signals pass to the bandpass filter 246, which allows only the desired signal at frequency f1 to pass and filters out the other undesired signals.

In operation, the switch controller 298 extracts transmit and receive timing information from MAC scheduler or the base band module, which TDD system or chipset vendors provide.

Thus, in accordance with the embodiment of FIG. 6 there is provided an antenna system including an integrated antenna 230 which consists of three antenna pieces (refer to 203*a*) with each antenna is designed for one designated frequency band. The integrated antenna 230 is virtually shared by three radios (or transceivers) 290, 292 and 294 hence there are three separate antennas co-located in one enclosure and separated each other 0.168 meters. The circulator 232 passes the signal from transmitter 276 towards the antenna, while it blocks the signal going to the receiver 282. Similar functions are performed by circulators 234 and 238. The isolator 240 passes the signal from transmitter 276 and converts the signals from the reverse direction to thermo and dissipated through grounding 241. The tunable band-pass filter 246 band-passes frequencies associated with frequency f1 and rejects all other frequencies. Preferably the band-pass filter is a 5th order Chebeshev filter and has a bandpass of 70 MHz with 60 dB rejection on adjacent bands. There are similar bandpass filters 248 and 250 for other two radios. The switch controller 298 controls the coupled TDD switches 252 and 258, 254 and 260, 256 and 262 such that when in transmit mode, for example, the radio 290, the controller 298 will instruct TDD switch 252 to turn on and TDD switch 258 to turn off, similarly, in receive mode, for the radio 292, the controller 298 will instruct switch 254 to turn off and 260 to turn on.

In practice, the radio 290 is in transmit mode while 292 is in receiving mode. The undesired signal transmitted on frequency f1 is received by antenna designed on frequency f2, which then leaks into receiver 284. If the undesired signal strength is 23 dBm, the signal is first attenuated 12 dB due to antenna separation, then experiences an insertion loss of 8dB and filter rejection loss 60 dB and 3 dB loss when passed through switch 260. Hence, the undesired signal is reduced to 23−12−8−60−3=−60 dbm before it gets into receiver 284 and where the receiver further reduces this undesired signal.

In accordance with another embodiment there is provided a method including the steps of 1) deciding how many octes N in the desired whole frequency band 2) dividing the whole frequency bands into N groups such that the frequencies among groups have the largest separation 3) designing N antennas with each optimized for one band group 4) integrating N antennas as a whole and enclosing them into one enclosure 4) allocating frequencies to antennas according to each group.

Figure 7:
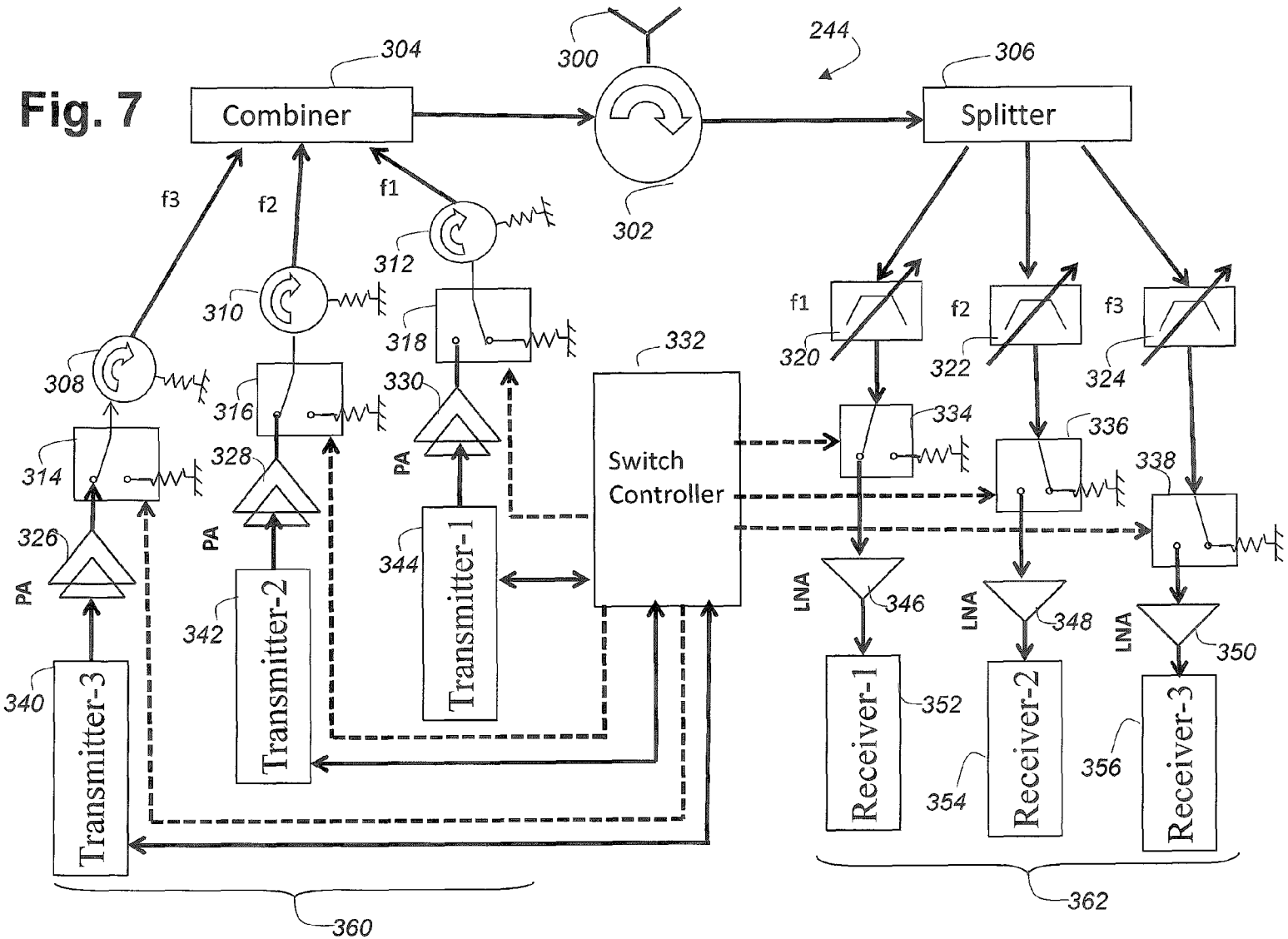
FIG. 7 illustrates another asynchronous TDD radio antenna sharing system in accordance with a third embodiment of the present disclosure.

Referring to FIG. 7 there is another illustrated antenna sharing system for asynchronous TDD radios in accordance with a third embodiment of the present disclosure. The antenna 300 is a wide band antenna that can transmit and receive in multiple frequencies. The TDD radio systems 360 and 362 illustrate three TDD radios and each radio is a pair of a transmitter and a receiver, more precisely 340 and 352, 342 and 354, 344 and 356.

The transmit side 360 includes separate transmitters 340, 342 and 344 for each resonant frequency f1, 12 and f3, respectively. Which in turn are coupled via respective power amplifiers 326, 328 and 330, switches 314, 316 and 318 to a combiner 304. The combiner 304 is coupled to master circulator 302 connected to the shared antenna 300. The receive side 362 includes a splitter 306 which coupled to the master circulator 302 and split the signal into plurality of signals that are fed into plurality of bandpass filters 320, 322 and 324 respectively. Which are in turn coupled via switches 334, 336 and 338 and low-noise amplifiers 346, 348 and 350 to respective receivers 352, 354 and 356.

In operation, the switch controller 332 is driven by the MAC scheduler of the TDD radio system. Note that while FIG. 7 shows switches 314 and 316 closed on the transmit side and switch 334 closed on the receive side, all of the switches can be in either a closed or open state at any given point in time.

In accordance with the embodiment of FIG. 7, there is another antenna system including an integrated antenna 300, a circulator 302 which passes all the transmitted signals through toward the antenna and blocks all the transmitted signals toward receivers, a combiner 304, which combines all the signals in transmission direction, a plurality of isolators 308, 310 and 312 which block the transmitted signals to return to plurality of power amplifiers 326, 328 and 330. A splitter splits the received signal into a plurality of signals that is fed into each receiver chain respectively, followed by tunable band-pass filters 320, 322 and 324 that further limit the undesired signals get into each receiver chain, a plurality of TDD switches 314, 316, 318 and 334, 336 and 338 and a switch controller 332, which will turn off each of plurality of transmitters when the corresponding receiver is in receiving mode. The integrated antenna 300 is either one piece of metal resonates in multiple frequencies or plural pieces of metal and each resonates at a desired frequency and all pieces of antenna mechanically integrated together and enclosed within one enclosure physically looks like one antenna.

Figure 8:
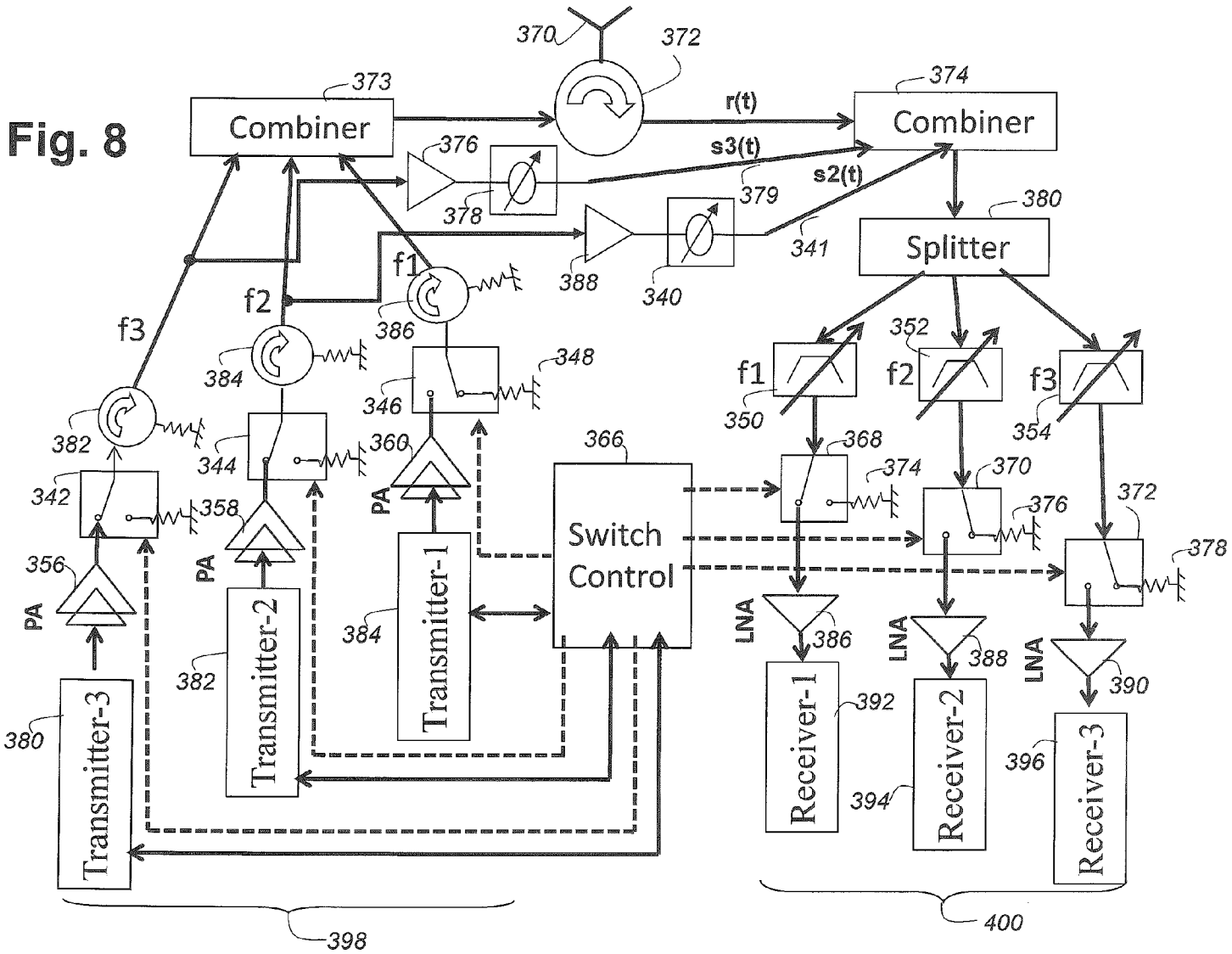
FIG. 8 illustrates yet another asynchronous TDD radio antenna sharing system in accordance with a fourth embodiment of the present disclosure.

Referring to FIG. 8 there is illustrated yet another antenna sharing system for asynchronous TDD radio systems in accordance with a fourth embodiment of the present disclosure. The fourth embodiment is similar to that of FIG. 7, but the transmit side 398 is modified with the addition of feed forward paths 379 and 341 for transmit signals at carrier frequencies f3 and f2, respectively. Each feed forward path 379 and 341 includes an amplifier 376 and 388 and phase shifters 378 and 340, respectively coupled another combiner 374 to the splitter 380. The combiner 374 cancels the undesired signals from the co-located transmitters by subtracting the coupled versions of the transmitted signals from the received signal r(t), the output of combiner 374 is r(t)−s2(t)−s3(t).

In operation, the switch control 366 controls respective ones of transmit switches 342, 344 and 346 and receive switches 368, 370 and 372. So that one transmitter or one receiver is coupled to the antenna at any given moment. Separation of the transmitted and received channels can greatly increase the isolation between the transmit and receive sides of co-located radios.

The feedback paths provided in embodiment two further reduce interference between transmit and receive sides.

In accordance with the embodiment of FIG. 8, there is another antenna sharing system including an integrated antenna 370, a circulator 372. a combiner 373, which will combine plurality of signals from plurality of transmitters. The combined signal passes though the circulator 372 and radiates into the air through antenna 370. Although circulator 372 is intended to block all transmitted signals leaking into the receiver chain, some of transmitted signal still pass through circulator toward receivers. Therefore another combiner 374 is equipped to cancel them by subtracting the coupled versions of the transmitted signals from the received signal r(t), the output of combiner 374 is then r(t)−s2(t)−s3(t). The splitter 380 slits the signal into plurality of signals each further cleaned up by a band-pass filter 350, 352, and 354 with each respective signal going to the next stage of receiving process.

Numerous modifications, variations and adaptations may be made to the particular embodiments described above without departing from the scope patent disclosure, which is defined in the claims.

What is claimed is:

1. A system of antenna sharing for asynchronous time-division duplex (TDD) radios comprising:

a plurality of TDD transmitters, each transmitter operable on a predetermined set of channels and coupled via a respective transmit switch to an antenna, wherein each channel corresponds to an ultra-high frequency (UHF) television channel designation;

a plurality of TDD receivers, each receiver associated with one of the plurality of TDD transmitter and operable on the predetermined set of channels and coupled via a respective receive switch to a splitter and in turn to an antenna; and a switch controller connected to respective transmit and receive switches for asynchronously connecting at least one TDD transmitter and at least one TDD receiver to the antenna for effecting antenna sharing among the plurality TDD receivers and TDD transmitters driven by a media access control (MAC) scheduler, and an integrated antenna -with plurality of co-located antennas and a circuit to limit co-located transmitter signals coupled to the transmit and receive switches;

wherein when one of the plurality of TDD transmitter is connected to the integrated antenna when the respective transmit switch is closed, and the at least one TDD receiver associated with the respective at least one TDD transmitter is disconnected from the integrated antenna and the respective receive switch is open wherein more than one of the plurality of TDD transmitters can be transmitting at any one time.

2. The system of claim 1, wherein the plurality is two, three or four.

3. The system of claim 1, wherein the UHF television channels are channel 14 through channel 50.

4. The system of claim 3, wherein the channels are divided into groups.

5. The system of claim 4 wherein the groups are channels 14-25, channels 26-38 and 39-50.

6. The system of claim 1 wherein the antenna is segmented into sectors.

7. The system of claim 6 wherein the sectors correspond to a number of groups of channels.

8. The system of claim 1 wherein the circuit comprises a circulator, a band-pass filter of 70 MHz wide and a TDD switch.

9. The system of claim 8 wherein the band-pass filter has a 57 dB adjacent channel rejection.

10. The system of claim 1 wherein each of the plurality of transmitters is coupled via a respective transmit switch to a combiner and in turn to one of the plurality of antennas.

11. A method of antenna sharing, the method comprising:

dividing plurality of ultra-high frequency (UHF) television channels into a plurality of groups;

assigning each of the plurality of groups to one of a corresponding plurality of time-division duplex (TDD) transmitters and one of an associated plurality of TDD receivers; and asynchronously coupling at least one of the TDD transmitters and at the least one of the associated TDD receivers to the antenna to effect sharing of the antenna among a corresponding plurality of TDD transmitters and TDD receivers through a switch controller driven by a media access control (MAC) scheduler wherein when one of the plurality of TDD transmitters is assigned to transmit the associated one of a plurality of TDD receivers is decoupled from the antenna to reduce interference between the associated at least one TDD transmitter and at least one TDD receiver wherein more than one of the plurality of TDD transmitters may be transmitting at any one time.

12. The method of claim 11, wherein the plurality is three.

13. The method of claim 11, wherein the UHF television channels are channel 14 through channel 50.

14. The method of claim 11, wherein the channels are assigned to predetermined frequency bands.

15. The system of claim 1, wherein the antenna is an integrated antenna including a plurality of co-located antenna sectors, wherein each of the plurality of transmitters and receivers is coupled to a corresponding antenna sector of the integrated antenna.

16. The system of claim 1, wherein each of the plurality of receivers is coupled via a respective switch to a splitter and in turn to the integrated antenna.

17. The method of claim 11, further comprising segmenting the antenna into a plurality of co-located antenna sectors corresponding to the plurality of groups, each antenna sector having a characteristic associated with a corresponding group.

18. The method of claim 11 wherein the UHF channels are divided into group by:

determining how many octes N in a desired group;

dividing UHF television channels into N groups such that the frequencies among the plurality of groups have the largest frequency separation; and designating N antenna elements of an antenna to one of the plurality of groups.

19. The system of claim 15, wherein the plurality of co-located antennas sectors are mutually separated 0.168 m or larger.

* * * * *